US005447615A

United States Patent [19]

Ishida

[11] Patent Number: 5,447,615

[45] Date of Patent: Sep. 5, 1995

[54] PLATING DEVICE FOR WAFER

[75] Inventor: Hirofumi Ishida, Hiratsuka, Japan

[73] Assignee: Electroplating Engineers Of Japan Limited, Tokyo, Japan

[21] Appl. No.: 263,729

[22] Filed: Jun. 22, 1994

[30] Foreign Application Priority Data

Feb. 2, 1994 [JP] Japan ..... 6-029146

[51] Int. Cl.[6] ..... C25D 17/06

[52] U.S. Cl. ..... 204/224 R; 204/297 R

[58] Field of Search ..... 204/224 R, 297 R, 297 W

[56] References Cited

U.S. PATENT DOCUMENTS

| | | | |
|---|---|---|---|
| 3,835,017 | 9/1974 | Mentone et al. | 204/224 R |
| 4,137,867 | 2/1979 | Aigo | 118/627 |
| 4,170,959 | 10/1979 | Aigo | 118/627 |
| 4,339,319 | 7/1982 | Aigo | 204/224 R |
| 4,428,815 | 1/1984 | Powell et al. | 204/297 W |
| 4,605,483 | 8/1986 | Michaelson | 204/280 |
| 4,861,452 | 8/1989 | Stierman et al. | 204/297 W |
| 4,874,476 | 10/1989 | Stierman et al. | 204/15 |
| 4,931,149 | 6/1990 | Stierman et al. | 204/15 |
| 4,971,676 | 11/1990 | Doue et al. | 204/297 R X |
| 5,000,827 | 3/1991 | Schuster et al. | 204/15 |
| 5,024,746 | 6/1991 | Stierman et al. | 204/297 W |
| 5,227,041 | 7/1993 | Brogden et al. | 204/297 R |
| 5,228,967 | 7/1993 | Crites et al. | 204/297 W X |
| 5,342,495 | 8/1994 | Tung et al. | 204/297 R |

FOREIGN PATENT DOCUMENTS

| | | | |
|---|---|---|---|
| 56-5318 | 2/1981 | Japan | C25D 5/02 |
| 57-159029 | 10/1982 | Japan | H01L 21/306 |
| 58-19170 | 4/1983 | Japan | C25D 5/02 |
| 60-231330 | 11/1985 | Japan | H01L 21/306 |
| 238472 | 3/1990 | Japan | C25D 7/12 |
| 2122067 | 10/1990 | Japan | C25D 5/08 |
| 31970 | 1/1991 | Japan | C25D 5/08 |
| 5320978 | 12/1993 | Japan | C25D 5/08 |

*Primary Examiner*—Donald R. Valentine

*Attorney, Agent, or Firm*—Michael D. Bednarek; Marks & Murase

[57] ABSTRACT

Disclosed is a plating device for plating a wafer, in which the resist film formed on a wafer need not preliminarily be removed, and plurality of needle-like electrodes can stably and reliably be contacted with the wafer to secure electrical continuity therewith and attachment of the plating metal onto the needle-like electrodes can effectively be prevented. Referring to the constitution of the plating device, the periphery of the wafer is pressed against the mounting surface provided around the opening edge of a plating tank with the aid of a holding means, and the wafer is as such brought into contact with the plating solution contained in the plating tank to carry out plating treatment, in which needle-like electrodes are provided in such a way that the tips thereof may slightly protrude above the mounting surface and that they may elastically be deformed to be retractable below the mounting surface; and the needle-like electrodes are pressed by the wafer which is pressed and elastically deformed by the holding means against the mounting surface to remove the resist film present at the contacted portion utilizing the force of press contact to acquire electrical continuity between the needle-like electrodes and the wafer.

8 Claims, 6 Drawing Sheets

PLATING DEVICE FOR WAFER

BACKGROUND OF THE INVENTION

1. Field of the Invention

The present invention relates to a plating device for applying a bump-plating treatment to wafers as one of the steps in the process for producing a semiconductor.

2. Description of the Prior Art

Bump-plating of a wafer is generally carried out by bringing the wafer immobilized as pressed onto the mounting surface around the opening of a cup-like plating tank into contact with a plating solution contained in the plating tank (e.g. as disclosed in Japanese Utility Model Laid-Open Publication Nos. Hei 2-38472 and Hei 2-122067, or Japanese Patent Laid-Open Publication No. Hei 5-320978).

Such plating treatment of the wafers involves some problems, and one of them is how to secure electrical continuity between the wafer, especially one which must be charged from the surface thereof on which a resist film is formed, and the cathode. In one of the measures to solve such problems, the resist film formed on the surface of the wafer is pierced with the sharp point of a needle-like electrode to be penetrated thereby when the wafer is immobilized as pressed onto the mount. This method involves problems that the adjustment of the height of the electrode is difficult, and that if a plurality of needle-like electrodes are provided, unstable contact of the needle-like electrodes is caused due to the nonuniform height thereof, etc. (e.g. as described Line 3, Page 4 to Line 1, Page 5 of Japanese Utility Model Laid-Open Publication No. Hei 2-38472).

Similar technique which also employs needle-like electrodes is disclosed, for example, in Japanese Utility Model Laid-Open Publication No. Sho 58-19170, which has overcome the problem of such nonuniform height of electrodes. According to this technique, each of the needle-like electrodes, the point of which is crooked upward, is allowed to protrude inward from the wall surface of a plating tank like a cantilever. This cantilever structure imparts elasticity to the electrode to enable absorption of unevenness in the height of the needle-like electrodes. However, no consideration is taken for the liquid tightness of the needle-like electrode against the plating solution in this structure, so that there remains an inconvenience that the plating metal deposits on the exposed portion of the needle-like electrode.

There is another technique in which a plate-like electrode is pressed against a wafer via a conductive buffer plate, as disclosed in Japanese Utility Model Laid-Open Publication No. Hei 2-38472. This method, although it can overcome the problems inherent in the technique using needle-like electrodes, involves other problems. Namely, the resist film present over the range to be pressed against the electrode must preliminarily be removed in this method to increase the number of steps; the yield is affected, since more than a predetermined width of the resist film must actually be removed over the entire periphery of the wafer; and so forth.

SUMMARY OF THE INVENTION

The present invention was accomplished under such circumstances, and it is an objective of the invention to provide a plating device for wafer which can achieve stable and reliable contact to secure electrical continuity of a plurality of needle-like electrodes with a wafer, without preliminarily removing the resist film, and which can effectively prevent deposition of the plating metal to the needle-like electrodes.

In the plating device for wafer according to the present invention, a wafer is pressed at the periphery against the mounting surface provided along the opening edge of the plating tank using a holding means, then the wafer is plated by being allowed to contact with the plating solution contained in the plating tank. The wafer is mounted in such a way that each of the needle-like electrodes for charging the wafer may slightly protrude above the mounting surface and that the tip of the electrode may flex elastically to be retractable below the mounting surface, whereby the needle-like electrodes are pressed by the wafer which is pressed against the mounting surface by the holding means to remove the resist film formed on the wafer at the portions press-contacted with the needle-like electrodes and secure electrical continuity between the needle-like electrodes and the wafer.

Since the needle-like electrodes are adapted to undergo elastic deformation to be pressed against the wafer, as described above, no instability in the contact of the electrodes will be caused, even if there may be some degree of unevenness in the heights of the electrodes. In other words, each needle-like electrode undergoes elastic deformation as pressed by the wafer, and the level of the tip of each needle-like electrode is regulated by the contact surface of the wafer, so that it can constantly secure stable and reliable electrical continuity without being affected by the unevenness in the height of the needle-like electrodes. Further, the projection of each needle-like electrode can relatively easily be adjusted based on the same reason. Thus, the plating operation can be facilitated according to the plating device of the present invention.

Besides, since elastic deformability, which is the attribute of the needle-like electrodes themselves, is utilized for the absorption of unevenness in the height thereof and of unevenness in the contact, the structure of the electrode unit (to be described later) including the needle-like electrodes can extremely be simplified advantageously as compared with the cases where extra members such as a spring are employed for unevenness-absorbing purpose.

Further, the tip of such needle-like electrode protruding slightly above the mounting surface is adapted to retract below the mounting surface depending on the degree of press contact with the wafer. Since the wafer is thus pressed against the mounting surface, the portions of the wafer around the needle-like electrodes can be blocked from the plating solution, providing high liquid tightness to the needle-like electrodes against the plating solution.

Such elastically deformable needle-like electrodes are preferably formed to have the shape of leaf spring and direct diagonally upward toward the center of the plating tank.

Referring now to the securing of liquid tightness of the needle-like electrodes to be achieved by pressing the wafer against the mounting surface, preferably, an annular peripheral member for receiving the peripheral portion of the wafer is disposed on the mounting surface; sealing portions are allowed to protrude inward from the inner periphery of the peripheral member at the positions corresponding to the locations of the needle-like electrodes such that the upper surface thereof and the mounting surface may be on the same plane; and allowing the tips of the needle-like electrodes to protrude through the openings defined in these sealing portions, respectively. According to such structure, the liquid tightness of the needle-like electrodes against the plating solution can be enhanced by forming the peripheral member, particularly the sealing portions thereof using an elastic material having rubber-like elasticity, and further liquid tightness of a plurality of needle-like electrodes can be secured using one peripheral member, so that the handling of the needle-like electrodes becomes easy compared with the case where independent sealing members are employed for the respective needle-like electrodes, advantageously.

In setting the needle-like electrodes on the plating tank, an electrode block having an insertion hole in which a needle-like electrode is fitted and an insulated electrode box in which the electrode block is to be accommodated with the tip of the needle-like electrode protruding from the insertion opening are allowed to constitute an electrode unit, and such electrode units are removably set to the plating tank. Thus, replacement, maintenance and management of the electrodes can be facilitated.

Further, an air bag is preferably used as the holding means. The air bag has a substantially annular form corresponding to the profile of the wafer and is disposed along the outer periphery of the mounting surface. The air bag is inflated by supplying air thereto to constrain the periphery of the wafer and press it against the mounting surface, whereas the air bag is deflated to resume the original state by exhausting the air to release the constraint.

Uniform and elastic pressure can be applied to the periphery of the wafer by employing the pressure of such air bag, and more stable and reliable contact can be secured coupled with the above properties of the elastically deformable needle-like electrodes.

The objects, characteristics, advantages, etc. of the present invention may be understood by reference to the following description taken in conjunction with the attached drawings. The present invention may be embodied in many other specific forms without departing from the spirit or scope of the invention. Therefore, the present embodiment is to be considered as illustrative and not restrictively, and the invention is not to be limited to the details given herein, but may be modified within the scope of the appended claims.

DESCRIPTION OF THE PREFERRED EMBODIMENT

One embodiment of the present invention will now be described below.

Figure 1:
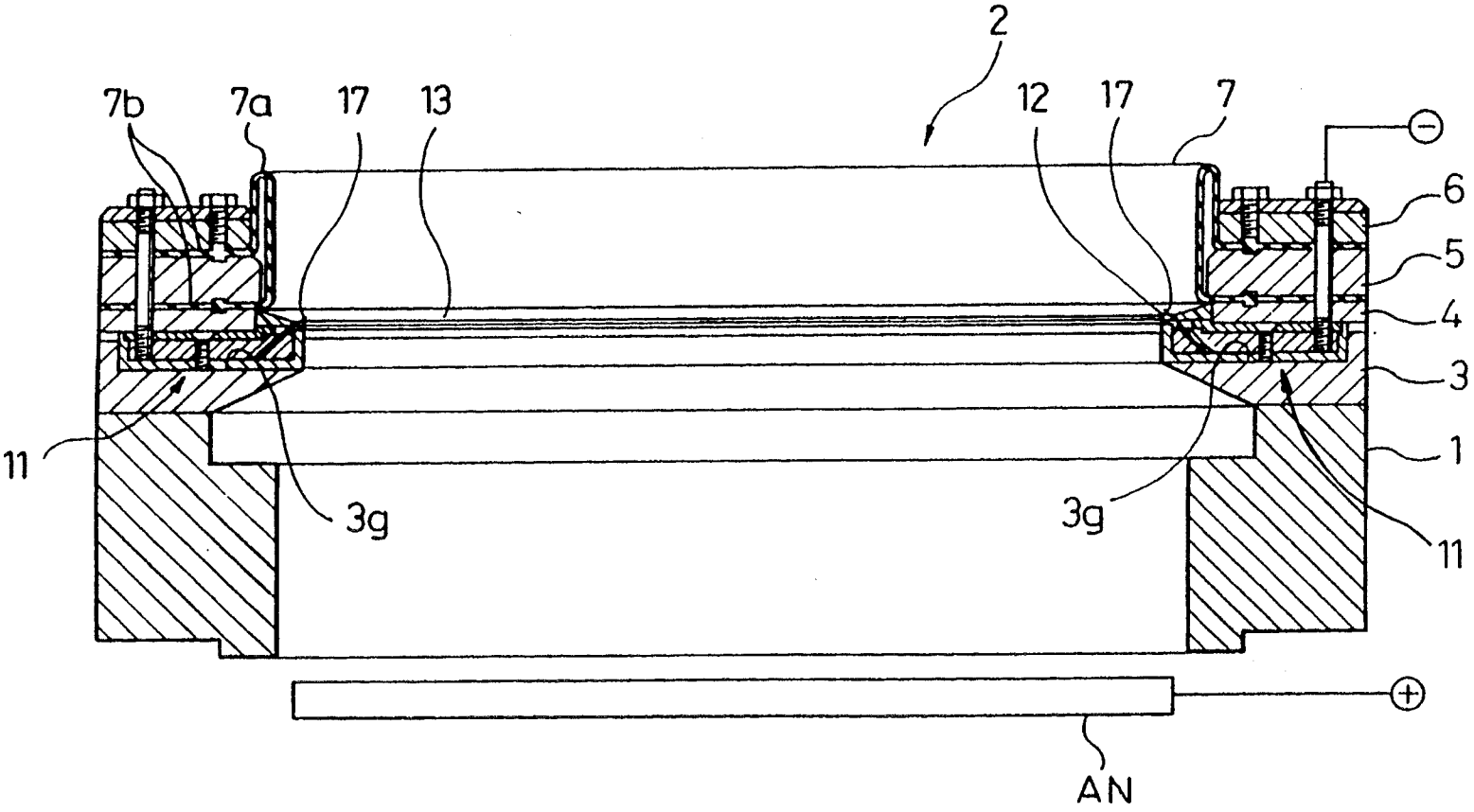
FIG. 1 is a cross-section taken along the view $SA_1$-$SA_1$ in FIG. 2.
Figure 2:
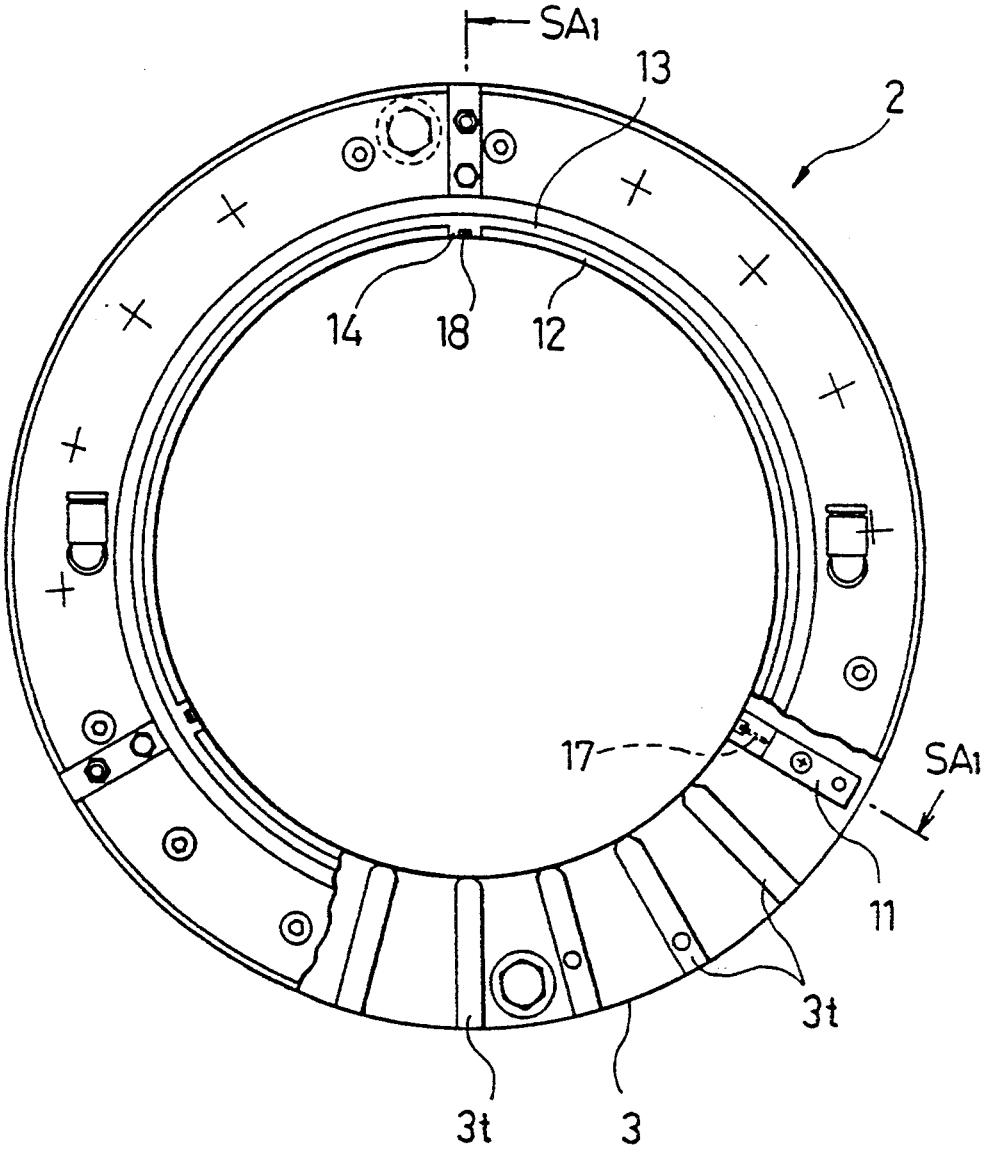
FIG. 2 is a plan view of a plating device for wafer according to the embodiment of the invention.

The plating device for wafer according to the embodiment of the invention is provided with a cylindrical plating tank 1 having an upper opening, with a head 2 being provided along the upper opening thereof, as shown in FIGS. 1 and 2. This head 2 consists of a base plate 3, a mounting surface providing plate 4, a core plate 5, a fixing plate 6 and an air bag 7, which all have annular forms and are, except said air bag 7, made of plastics, more typically PVC resins, respectively.

The base plate 3 has radial ridges **3*t* at predetermined intervals (see FIGS. 2 and 3), and plating solution discharging paths having a depth corresponding to the height of the radial ridges 3*t* are adapted to be formed between the base plate 3 and the lower surface of the mounting surface providing plate 4. Meanwhile, three electrode fitting grooves 3*g* are defined at 120° intervals as electrode fitting sections, in which electrode units 11** (to be described later) are adapted to be accommodated.

Figure 3:
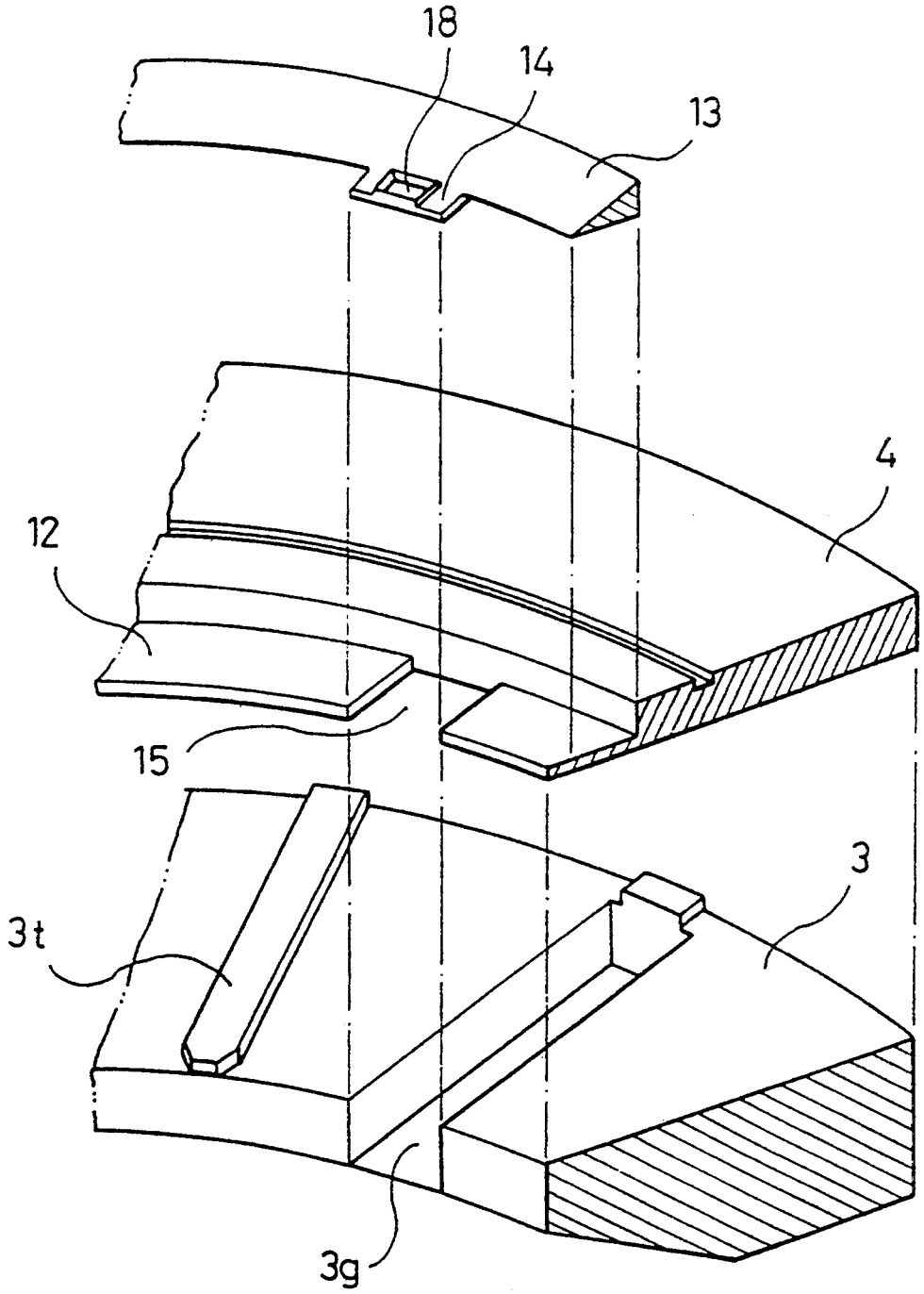
FIG. 3 shows in partial exploded perspective view how a base plate, a mounting surface providing plate and a peripheral members are incorporated with each other.

The mounting surface providing plate 4, the details of which are as illustrated in FIG. 3, has a step along the inner periphery thereof so as to provide a mounting surface 12, and a peripheral member 13 having a predetermined width is disposed along the outer periphery of the mounting surface 12, so that the inner peripheral portion of the peripheral member 13 may support the outer periphery of a wafer U (see FIG. 4) over a width of about 3 mm. The step i.e. the mounting surface 12 has notches 15 as receiving portions for receiving therein the sealing portions 14 of the peripheral member 13 at the positions corresponding to the locations of the electrode fitting grooves **3*g* of the base plate 3**.

The peripheral member 13 to be fitted on the mounting surface providing plate 4 is made of an elastic material, more specifically a silicone resin, and has an annular form with a wedge-like cross section. The reason why the peripheral member 13 is allowed to have a wedge-like cross section is that the plating solution, if leaked from the surface thereof abutted against the wafer U (see FIG. 4), may easily be returned to the plating tank 1 along the sloped surface of the wedge. The peripheral member 13 also has sealing portions 14 protruding downward and inward therefrom, which are fitted in the notches 15 to be on the same plane as the mounting surface 12, with openings 18 for allowing the needle-like electrodes 17 to protrude therethrough being defined in the sealing portions 14, respectively.

Figure 4:
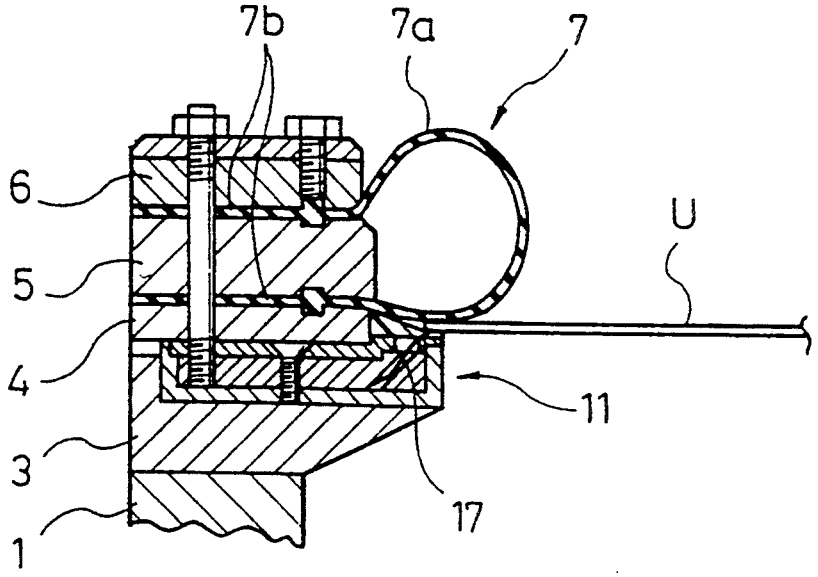
FIG. 4 is a partially enlarged cross-sectional view showing an inflated air bag.

The core plate 5 and the fixing plate 6 are used for sealing and fastening the air bag 7. Namely, the air bag 7 is made of a rubbery material and has an annular body consisting of a bulge **7*a* having a cross section as shown in FIG. 1 and roots 7*b*. The bulge 7*a* can be sealed by interposing the core plate 5 between the roots 7*b* and fastening the fixing plate 6 downward, and thus the bulge 7*a* can be inflated upward, downward and inward by introducing air thereto, as shown in FIG. 4. The wafer U can uniformly be constrained along the periphery thereof by the inflated air bag 7 to be elastically pressed against the mounting surface 12**.

Figure 5:
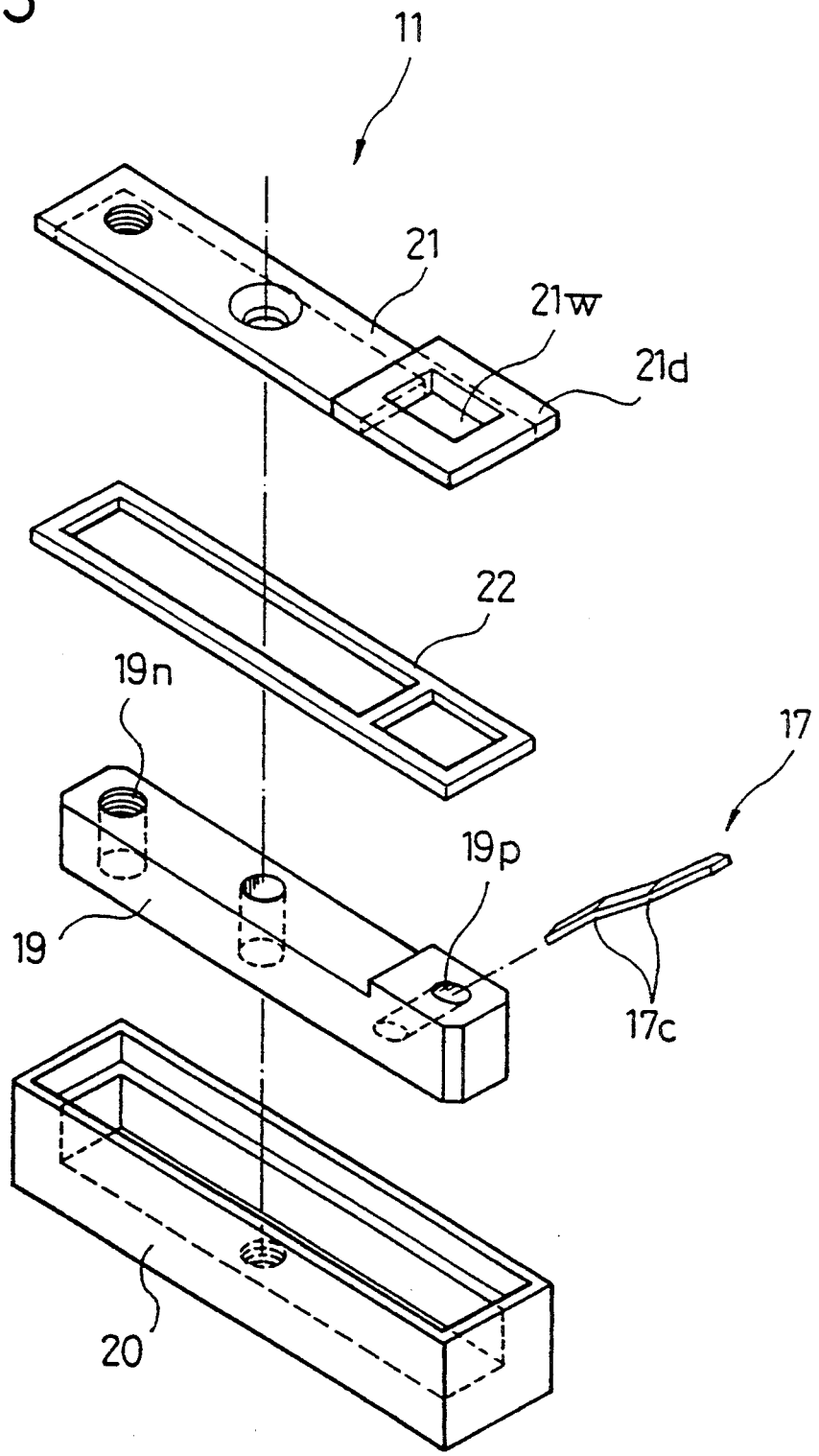
FIG. 5 is an exploded perspective view of an electrode unit.

The electrode unit 11, as shown in FIG. 5, has an elongated plate-like form and consists of an electrode block 19 which has an elongated square rod-like shape and also has an insertion hole **19*p* through which the needle-like electrode 17 having two bends 17*c* is to be inserted with the tip thereof facing diagonally upward and a threaded hole 19***n* for securing connection to the power source; and an electrode box in which the electrode block 19 is tightly accommodated. The electrode box consists of a box main body 20, a cover 21, and a packing 22. The cover 21 has a protrusion 21*d* with an opening 21*w*, so that the tip of the needle-like electrode 17 inserted to the insertion hole 19*p* of the electrode block 19 may protrude through the opening 21*w* diagonally forward. When the electrode unit 11 is fitted in the electrode fitting groove 3*g* of the base plate 3, as described above, the upper surface of the protrusion 21*d* of the cover 21 is brought into intimate contact with the lower surface of the corresponding sealing portion 14 of the peripheral member 13, and the tip of the needle-like electrode 17 slightly protrude diagonally upward toward the center of the plating tank 1 through the opening 18 of the sealing portion 14 (see FIG. 6(A)).

Figure 6A:
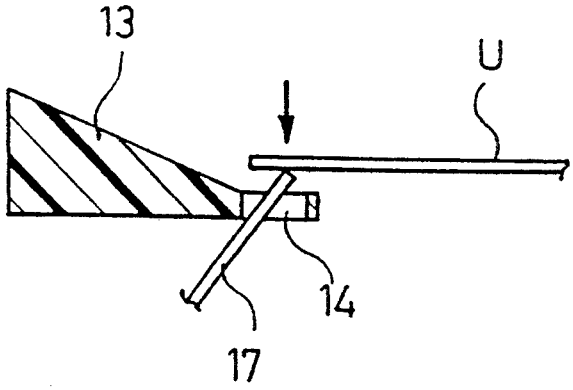
FIG. 6 is an explanatory view showing schematically the contact state of an needle-like electrode with a wafer.
Figure 6B:
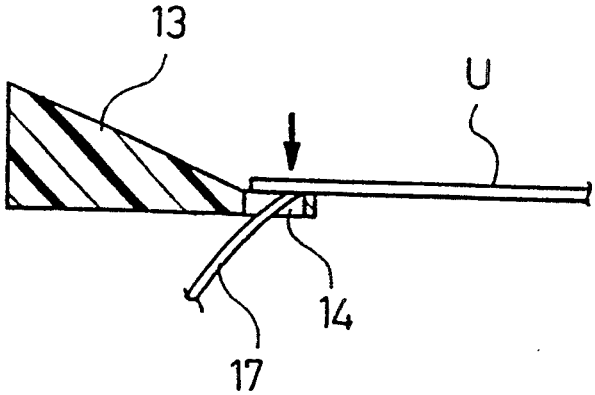

Accordingly, when a wafer U is mounted on the mounting surface 12 and the air bag 7 is inflated to press the wafer U against the mounting surface 12, the needle-like electrodes 17 flex, as the tips thereof are abutted against the wafer U and the wafer U is pressed against the mounting surface 12, to remove the resist film formed on the wafer U at the contacted portions; and finally electrical continuity is secured between the wafer U and the needle-like electrodes 17 (see FIG. 6(A)→FIG. 6(B)). In this state, the tip of the needle-like electrode 17 is substantially on the same plane as the upper surface of the sealing portion 14 or the mounting surface 12, so that the needle-like electrode 17 is sealed liquid tight against the plating solution by the sealing portion 14.

The plating using this plating device for wafer is carried out as follows.

A wafer U is first mounted horizontally on the mounting surface 12, and the air bag 7 is inflated by supplying air thereto through an air inlet not shown. Thus, the wafer U is pressed against the mounting surface 12 as constrained only at the periphery thereof by the air bag 7. In this process, the needle-like electrodes 17 as cathodes remove the resist film formed on the wafer to acquire electrical continuity with the wafer U, as described above.

When setting of the wafer U is completed as described above, plating solution is injected to form a flow in the plating tank 1 to pass through an anode AN, and the surface of the wafer U is contacted for a predetermined time to carry out plating treatment. The anode AN is structured as a rod, mesh, grid, etc. so as to readily contact with plating solution. After completion of the plating treatment, the air bag 7 is deflated, and the wafer U is removed from the mounting surface 12.

As described heretofore, according to the present invention, since the tip of each needle-like electrode slightly protruded above the mounting surface is designed to be pressed against the wafer as the former is elastically deformed to retract below the mounting surface, a plurality of needle-like electrodes can constantly be contacted stably and reliably with the wafer to secure electrical continuity therebetween requiring only relatively simple adjustment procedures of the needle-like electrodes. Besides, attachment of the plating metal onto the needle-like electrodes can effectively be prevented. Further, the electrode unit including the needle-like electrode can be simplified, and also cost reduction and easier handling in maintenance etc. can be realized.

What is claimed is:

1. A plating device for plating a wafer, said device comprising:

a plating tank having a mounting surface provided along an open edge of the tank for supporting a wafer mounted thereon;

holding means for pressing the periphery of said wafer against said mounting surface for bringing said wafer into contact with plating solution contained in said plating tank to carry out plating; and needle-like electrodes, for charging said wafer, having tips which slightly protrude above said mounting surface and may elastically be deformed to be retractable below said mounting surface to remove the resist film present at the contacted portion utilizing the force of press contact to acquire electrical continuity between said needle-like electrode and said wafer;

wherein an air bag employed as said holding means is disposed along the outer periphery of said mounting surface;

wherein said air bag is inflated by supplying a gas thereto to constrain the periphery of said wafer by pressing it against said mounting surface and deflated to its original state by exhausting the gas therefrom to release constraint.

2. The plating device for wafer according to claim 1, wherein said needle-like electrodes are provided diagonally upward toward the center of said plating tank.

3. The plating device according to claim 2, wherein an annular peripheral member overlapping with the periphery of said wafer is disposed on said mounting surface, and said peripheral member has sealing portions protruding inward therefrom at the positions corresponding to the locations of said needle-like electrodes, whereby the tips of said needle-like electrodes are adapted to protrude through the openings defined in said sealing portions, respectively.

4. The plating device according to claim 3, wherein electrode units, each consisting of a needle-like electrode, an electrode block having an insertion hole in which said needle-like electrode is inserted, and an insulated electrode box having an opening in which said electrode block is accommodated with the tip of said needle-like electrode protruding through said opening, are removably set onto said plating tank.

5. The plating device according to claim 2, wherein electrode units, each consisting of a needle-like electrode, an electrode block having an insertion hole in which said needle-like electrode is inserted, and an insulated electrode box having an opening in which said electrode block is accommodated with the tip of said needle-like electrode protruding through said opening, are removably set onto said plating tank.

6. The plating device for wafer according to claim 1, wherein an annular peripheral member overlapping with the periphery of said wafer is disposed on said mounting surface, and said peripheral member has sealing portions protruding inward therefrom at the positions corresponding to the locations of said needle-like electrodes, whereby the tips of said needle-like electrodes are adapted to protrude through the openings defined in said sealing portions, respectively.

7. The plating device according to claim 6, wherein electrode units, each consisting of a needle-like electrode, an electrode block having an insertion hole in which said needle-like electrode is inserted, and an insulated electrode box having an opening in which said electrode block is accommodated with the tip of said needle-like electrode protruding through said opening, are removably set onto said plating tank.

8. The plating device according to claim 1, wherein electrode units, each consisting of a needle-like electrode, an electrode block having an insertion hole in which said needle-like electrode is inserted, and an insulated electrode box having an opening in which said electrode block is accommodated with the tip of said needle-like electrode protruding through said opening, are removably set onto said plating tank.

* * * * *

UNITED STATES PATENT AND TRADEMARK OFFICE

CERTIFICATE OF CORRECTION

PATENT NO. : 5,447,615

DATED : September 5, 1995

INVENTOR(S) : Hirofumi ISHIDA

It is certified that error appears in the above—identified patent and that said Letters Patent is hereby corrected as shown below:

The words "for wafer" should be deleted from Col. 6, Claim 2, line 1 of the above patent.

Col. 6, line 1, claim 2, should read "The plating device according to claim 1"--

Signed and Sealed this

Twentieth Day of August, 1996

Bruce Lehman

*Attest:*

BRUCE LEHMAN

*Attesting Officer*

*Commissioner of Patents and Trademarks*